US011339655B2

(12) United States Patent
Friederichs et al.

(10) Patent No.: US 11,339,655 B2
(45) Date of Patent: May 24, 2022

(54) MILLING PICK

(71) Applicant: Betek GmbH & Co. KG, Aichhalden (DE)

(72) Inventors: Heiko Friederichs, Aichhalden (DE); Ulrich Krämer, Wolfach (DE)

(73) Assignee: Betek GmbH & Co. KG

( * ) Notice: Subject to any disclaimer, the term of this patent is extended or adjusted under 35 U.S.C. 154(b) by 0 days.

(21) Appl. No.: 17/046,590

(22) PCT Filed: Mar. 19, 2019

(86) PCT No.: PCT/EP2019/056864
§ 371 (c)(1),
(2) Date: Oct. 9, 2020

(87) PCT Pub. No.: WO2019/201535
PCT Pub. Date: Oct. 24, 2019

(65) Prior Publication Data

US 2021/0115792 A1 Apr. 22, 2021

(30) Foreign Application Priority Data

Apr. 17, 2018 (DE) ..... 10 2018 109 147.8

(51) Int. Cl.
*E21C 35/183* (2006.01)
*B28D 1/18* (2006.01)

(52) U.S. Cl.
CPC ..... *E21C 35/1837* (2020.05); *B28D 1/186* (2013.01)

(58) Field of Classification Search
CPC ..... E21C 35/1837; B28D 1/188
See application file for complete search history.

(56) References Cited

U.S. PATENT DOCUMENTS 4,893,875 A 1/1990 Lonn et al.
4,981,328 A 1/1991 Stiffler et al.
5,141,289 A 8/1992 Stiffler
(Continued)

FOREIGN PATENT DOCUMENTS

AT 371569 B 7/1983
CN 102498262 A 6/2012
(Continued)

OTHER PUBLICATIONS

Machine translation of WO 2008 104249 (Year: 2021).*
(Continued)

*Primary Examiner* — Janine M Kreck
(74) *Attorney, Agent, or Firm* — Lucian Wayne Beavers; Patterson Intellectual Property Law, PC

(57) ABSTRACT

The invention relates to a milling pick, in particular a round pick having a pick head and a pick tip, consisting of a hard material, wherein the pick tip has an attachment area, which is used to connect it to the pick head, wherein the pick tip has a concave area, which extends in the direction of the central longitudinal axis of the pick tip, and wherein the concave area has an elliptical contour. To achieve an improved resilience for such a milling pick, provision in made in accordance with the invention that the ellipse generating the elliptical contour is arranged in such a way that the semimajor of the ellipse and the central longitudinal axis of the pick tip form an acute angle.

18 Claims, 4 Drawing Sheets

(56) References Cited

U.S. PATENT DOCUMENTS

| | | | | |
|---|---|---|---|---|
| 5,823,632 | A | 10/1998 | Burkett | |
| 6,199,956 | B1 * | 3/2001 | Kammerer | E21C 35/183 299/111 |
| 8,783,785 | B2 | 7/2014 | Lehnert et al. | |
| 10,227,870 | B2 | 3/2019 | Lehnert et al. | |
| 2011/0068616 | A1 | 3/2011 | Ojanen | |

FOREIGN PATENT DOCUMENTS

| | | | | |
|---|---|---|---|---|
| DE | 19803166 | C2 | 5/2000 | |
| DE | 102007009711 | A1 | 9/2008 | |
| DE | 102013110676 | A1 | 3/2015 | |
| EP | 2894293 | A2 | 7/2015 | |
| GB | 2068040 | A | 8/1981 | |
| TW | 201014963 | A | 4/2010 | |
| WO | 2005017317 | A1 | 2/2005 | |
| WO | WO-2008104249 | A1 * | 9/2008 | E21C 35/183 |
| WO | 2014049162 | A2 | 4/2014 | |

OTHER PUBLICATIONS

International Search Report and Written Opinion of PCT/EP2019/056864, dated Jul. 1, 2019, 12 pages (not prior art).
Taiwanese Office Action of corresponding patent application No. 108113173, dated Dec. 15, 2021, 1 page (not prior art).

* cited by examiner

MILLING PICK

The invention relates to a milling pick, in particular a round pick having a pick head and a pick tip, consisting of a hard material, wherein the pick tip has an attachment area, which is used to connect it to the pick head, wherein the pick tip has a concave area, which extends in the direction of the central longitudinal axis of the pick tip, and wherein the concave area has an elliptical contour.

Such picks are known from DE 10 2007 009 711 B4, wherein the round pick has a pick shank and a pick head, which pick head bears a pick tip made of a hard material, preferably carbide. The base of the pick tip is connected to the pick head and has a concave area, in which the pick tip tapers in the direction of the central longitudinal axis. Adjacent to the concave area, a cylindrical segment is provided, with the concave area merging tangentially into the cylindrical area. The concave area forms an elliptical contour. This elliptical contour is generated by an ellipse having semi-axes of different lengths. The semimajor is aligned in parallel to the central longitudinal axis of the pick tip.

The known round picks are arranged on the surface of a fast-rotating milling drum of a road milling machine and, due to their optimized concave area, are designed to reduce the centrifugal forces occurring at the tool head by optimizing the weight while maintaining stability.

The known round picks meet the requirements for sufficient stability for the tensions occurring in particular during road milling. Owing to the high proportion of material costs for the carbide tip, there is a continuous need to reduce the weight of the tip in order to save material. However, sufficient stability required to complete the job sets a limit to these efforts.

The invention addresses the problem of providing a milling pick of the type mentioned above, which reliably absorbs and transfers the forces generated during operation, which has sufficient cutting ability and which is optimized with regard to the use of material.

This problem is solved by the ellipse generating the elliptical contour being arranged in such a way that the semimajor of the ellipse and the central longitudinal axis of the pick tip form an acute angle.

The rotated arrangement of the ellipse generating the elliptical contour provides material reinforcement in the foot segment of the concave area bearing the brunt of the wear, resulting in higher strength. Simultaneously, the front part of the concave area can remain sufficiently narrow resulting in a high cutting efficiency being maintained or increased. In this way, the milling tool of the invention can absorb and transfer the forces occurring during operation in an optimum manner, while at the same time being sufficiently resistant to fracture.

According to a preferred invention variant, provision is made that the acute angle is selected in the range from 30° to 60°. This range works for the typical ground-working applications. Preferably the range is selected from 40° to 50°. Such a range is optimized for use in road milling machines.

According to the invention, provision may also be made that the ratio of the length of the semimajor to the length of the semiminor of the ellipse producing the elliptical contour is chosen in the range from 1.25 to 2.5. At this ratio, the resulting pick tips are sufficiently slim in the tip area.

According to one conceivable variant of the invention, provision is made to arrange the ellipse generating the concave area such that the concave area does not intersect the semimajor and the semiminor of the ellipse. This results in harmonious transitions to the areas of the pick tip that adjoin the concave area.

If provision is made for a connection segment facing away from the pick head to adjoin the concave area, and for the center of the ellipse producing the concave area to be spaced apart from the transition point between the concave area and the connection segment in the direction of the longitudinal extension of the central longitudinal axis, wherein the center is offset in the direction of the pick head with respect to the connection segment, then the pick tip has a slender shape and the requirement for material savings is optimally taken into account.

According to the invention, provision can also be made that a connection segment is attached to the concave area facing away from the pick head, wherein the connection segment is preferably cylindrical and/or frustoconical, having a cone angle of less than 20°. This connection segment forms an active cutting area of the pick tip, which is the main wear area during operation. Across a cylindrical area, essentially constant geometric conditions at the pick tip can be maintained over a period of use. In this way, a uniform work product is achieved. Even with the specified frustoconical geometry of the connection segment, sufficiently good work products can still be achieved.

A milling pick according to the invention can be characterized by the fact that recesses are made in the concave area, which are distributed across the circumference of the pick tip and are preferably spaced equidistantly from each other. These recesses are used to improve the removal of the milled material and support the rotational behavior of a round pick. In addition, the indentations can also be used to reduce the amount of the expensive hard material used.

When dimensioning the recesses, care should be taken to ensure that they do not excessively reduce the stability of the pick tip. It has been shown to be advantageous if provision is made for the recesses to have a depth from the surface of the concave area of 0.3 mm to 1.2 mm.

In a particularly preferred embodiment of invention, an end segment of the pick tip directly or indirectly adjoins the connection segment facing away from the pick head, wherein the end segment comprises a tapered segment and an end cap, wherein the tapered segment has a maximum radial first extension at its first end facing the pick head and has a maximum radial second extension at its second end facing away from the pick head, wherein the end cap forms the free end of the pick tip and has the form of a spherical dome, wherein the base circle of the spherical dome has a diameter, and wherein the ratio of twice the maximum first extension (2 times e1) to the diameter of the base circle is in the range from 1.25 to 2.25. Such a milling pick has been optimized for road milling applications. This makes use of the findings that, for a larger diameter ratio, the pick tip is mainly worn at the end of the tapered segment facing the pick head, which results in an undesired excessive longitudinal wear of the pick tip. If the ratio is chosen to be less than 1.25, wear will occur preferably in the area of the end segment of the tapered segment facing the free end of the pick tip. As a result, the pick tip becomes blunt and loses its cutting efficiency. In consequence a greater force is required to guide the pick through the ground/subgrade to be worked. Then increased drive power is required. In the arrangement according to the invention, the wear zone is optimally distributed over the tapered segment, resulting in maximum tool life and a milling pick that has sufficient cutting power Provision may also be made in the invention in that a connection line from a point of the first maximum extension to a point of the second maximum extension is at an angle of 45° to 52.5° from the central longitudinal axis. This angle range also takes into account the effect described above (too rapid longitudinal wear or blunting of the pick tip).

Provision may also be made in the invention in that a connection line from a point of the first maximum extension to a point of the second maximum extension is at an angle of 47.5° to 52.5° from the central longitudinal axis, wherein the tapered segment is frustoconical or concave in shape. Alternatively, it is also conceivable that a connection line from a point of the first maximum extension to a point of the second maximum extension is at an angle of 45° to 50° from the central longitudinal axis, and that the tapered segment is convex in shape.

A possible variant of invention can also be such that the concave area facing the pick head has a maximum radial extension and the area facing away from the pick head has a minimum second radial extension in the radial direction, and that the connection line from the first to the second maximum extension and the central longitudinal axis form an acute angle in the range from 20° to 25°.

The invention is explained in greater detail below based on exemplary embodiments shown in the drawings. In the Figures.

Figure 1:
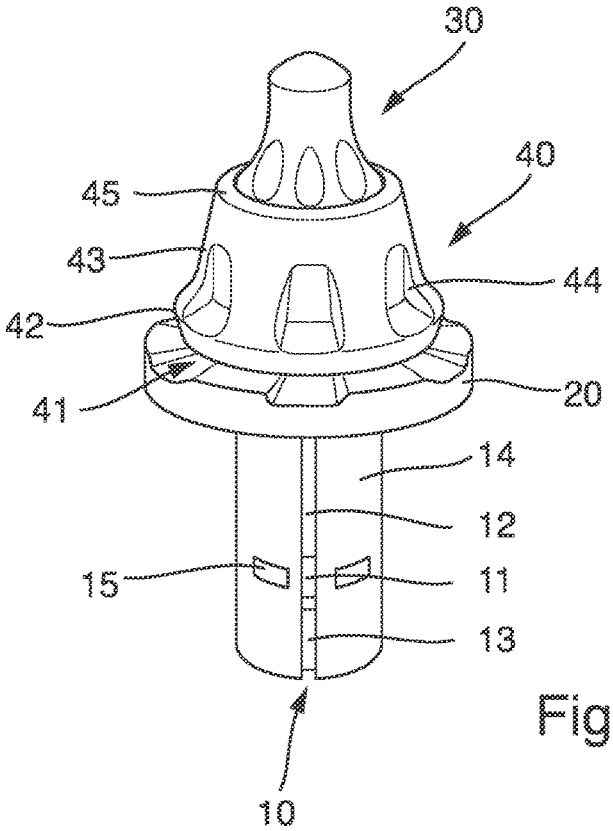
FIG. 1 shows a perspective side view of a first embodiment of a milling pick.

FIG. 1 shows a milling pick, in this case a round pick. This milling pick has a pick shank 10, to which a pick head 40 is integrally molded. A design variant is also conceivable, in which the pick head 40 is not integrally molded to the pick shank 10, but is manufactured as a separate component and connected to the pick shank 10.

The pick shank 10 has a first segment 12 and an end segment 13. A circumferential groove 11 runs between the first segment 12 and the end segment 13. Both the first segment 12 and the end segment 13 are cylindrical. The groove 11 is located in the area of the free end of the pick shank 10.

A clamping element 14, which in this case has the shape of a clamping sleeve, is mounted on the pick shank 10. It is also conceivable to attach another clamping element 14 to the pick shank 10. The clamping element 14 is used to immobilize the milling pick in a receiving hole of a toolholder. The clamping sleeve can be used to fix the milling tool in the receiving hole of the toolholder in such a way that the outer circumference of the clamping sleeve fits tightly against the inner wall of the receiving hole in a clamping manner.

The clamping element 14 has retaining elements 15. These retaining elements 15 engage with the circumferential groove 11. In this way, the milling pick can rotate freely in the clamping element 14 in the circumferential direction, but is held captive in the axial direction.

The clamping element 14 may be designed to be a clamping sleeve, as stated above. For this purpose, the clamping sleeve can consist of a rolled sheet metal segment. The retaining elements 15 can be stamped into the sheet metal segment, projecting in the direction of the groove 11. It is also conceivable that the retaining elements are partially cut free from the material of the sheet metal segment and bent in the direction of the groove 11.

A wear-protection disk 20 is mounted to the pick shank 10. The wear-protection disk 20 is located in the area between the assigned end of the clamping element 14 and a pick head 40. The wear-protection disk 20 can be rotated relative to both the clamping element 14 and the pick head 40.

Figure 5:
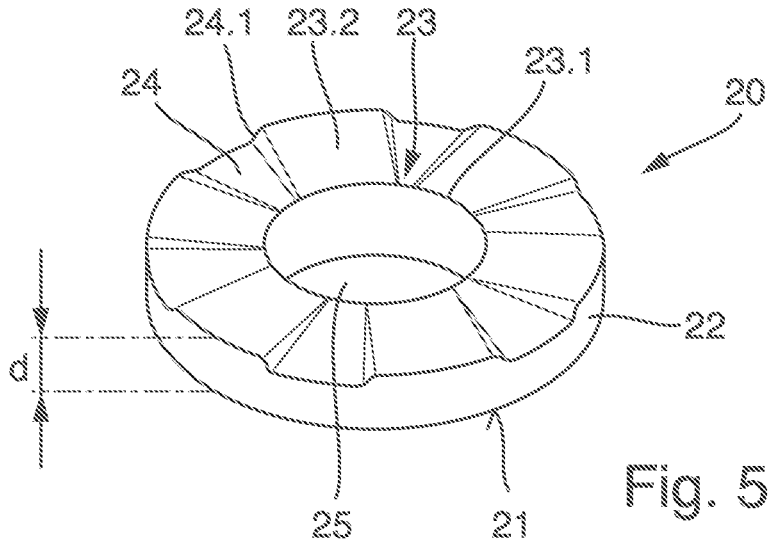
FIG. 5 shows a perspective view from above of a wear-protection disk (20) for use on one of the milling picks of FIG. 1 or 2.
Figure 6:
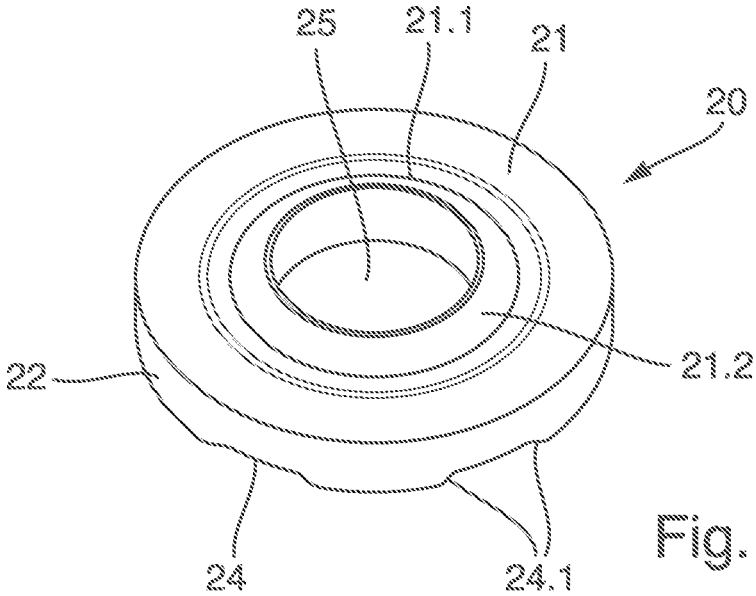
FIG. 6 shows a perspective bottom view of the wear-protection disk (20) of FIG. 5

The design of the wear-protection disk 20 can be seen in FIGS. 5 and 6. As these illustrations show, the wear-protection disk 20 can be of annular design. The wear-protection disk 20 has a central cut-out 25, which can be designed as a drilled hole. A polygon-shaped cut-out is also conceivable.

The wear-protection disk 20 has an upper counterface 23 and a support surface 21 on the underside facing away from the counterface 23. The support surface 21 can be aligned in parallel to the counterface 23. It is also conceivable that these two surfaces are at an angle from each other. Recesses 24 can be cut out from the counterface 23 or recessed into the counterface 23. In this exemplary embodiment, the recesses 24 are arranged equidistantly at a consistent division grid along the circumference. It is also conceivable that a varying division is provided. The recesses 24 divide the counterface 23 into individual surface segments 23.1, 23.2. Initially, a first surface segment 23.1 is formed, which is annular and revolves around the cut-out 25. The first surface segment 23.1 radially adjoins the second surface segments 23.2. The recesses 24 are used to space the second surface segments 23.2 at a distance from each. As FIG. 5 shows, the recesses 24 can merge into the adjacent second surface segments 23.2 via flank segments 24.1. The flanks 24.1 are inclined and extend at an obtuse angle to the second surface segment 23.2. As FIG. 5 further shows, the recesses 24 extend continuously towards the first surface segment 23.1. The surface segments 23.1, 23.2 form a level bearing surface for a pick head 40.

FIG. 6 shows the underside of the wear-protection disk 20. Here the support surface 21 is clearly visible. A circumferential groove 21.1 is recessed into the support surface 21. The circumferential groove 21.1 is directly or indirectly adjoined by a centering attachment 21.2. The centering attachment 21.2 is designed to be conical. It is arranged circumferentially around the cut-out 25 shaped like a drilled-hole.

On its outer circumference, the wear-protection disk 20 is limited by an annular circumferential rim 22.

Figure 2:
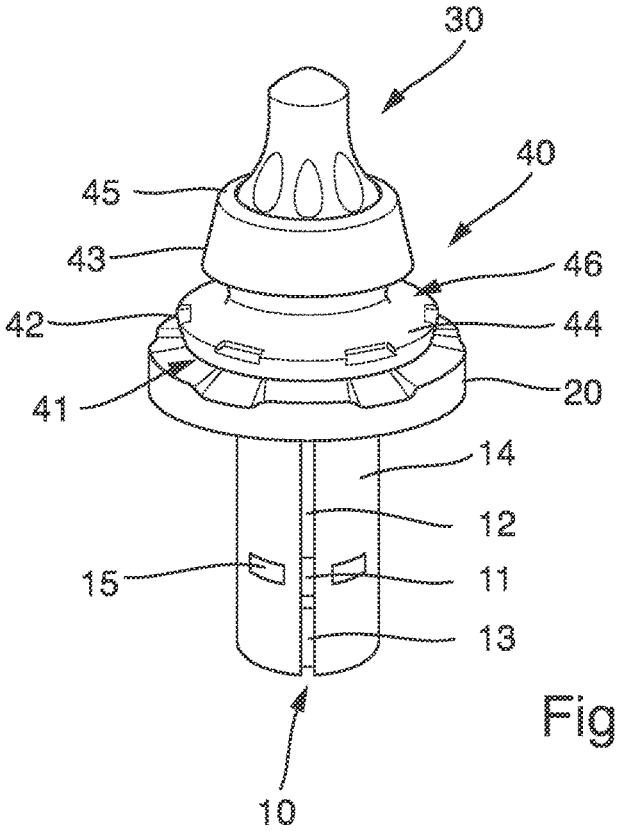
FIG. 2 shows a perspective side view of a second embodiment of a milling pick.

The cut-out of the wear-protection disk 20 can be slid onto the pick shank 10. In the mounted state, as shown in FIGS. 1 and 2, the cut-out 25 of the wear-protection disk 20 encloses a cylindrical segment of the milling pick. This cylindrical segment can be formed by the first segment 12 of the pick shank 10. Preferably, however, a further segment is connected to the first segment 12, which forms the cylindrical segment. The cylindrical segment is enlarged in diameter compared to the first segment 12 and concentric thereto.

It is also conceivable to use the wear-protection disk 20 as an assembly aid. In this case, the wear-protection disk 20 is mounted on the outer circumference of the clamping element 14. In this exemplary embodiment, the clamping element 14 is designed as a longitudinally slotted clamping sleeve. The cut-out 25 has a smaller diameter than the clamping sleeve in its spring-loaded state shown in FIGS. 1 and 2. When the cut-out 25 of the wear-protection disk 20 is then mounted to the outer circumference of the clamping sleeve, it is in a pretensioned state. This pretensioned state is selected in such a way that the clamping sleeve can be inserted into the receiving hole of a toolholder using little or no force. The insertion movement into the toolholder is then limited by the wear-protection disk 20. The support surface 21 at the bottom of the wear-protection disk then strikes against an assigned wear surface of the toolholder. The milling pick can then be driven further into the receiving hole of the toolholder, for instance by hitting it using a mallet. The wear-protection disk is pushed off the clamping sleeve until it reaches the position shown in FIG. 1 or 2. The clamping sleeve can then spring open more freely in the radial direction, wherein the clamping sleeve is used to clamp the milling tool in the receiving hole. In this state, the clamping sleeve is clamped to the milling tool in the receiving hole. The tool shank 10 can then be freely rotated in the clamping sleeve in the circumferential direction. The retaining elements 15 are used to hold it axially captive.

The wear-protection disk 20 has a disk thickness d between the support surface 21 and the counterface 23. The ratio of this disk thickness d to the diameter of the cut-out 25 or to the diameter of the cylindrical segment of the pick shank 10 associated with the cut-out 25 ranges from 2 to 4.5. In this exemplary embodiment, this ratio is 2.8, for a disk thickness d of 7 mm. The disk thickness d is preferably selected in the range from 4.4 mm to 9.9 mm. For such a disk thicknesses d, an improvement can be achieved compared to the milling picks known from the state of the art. In particular, the head 40 of the milling pick can be made shorter in the axial direction of the milling pick, wherein the shortening of the pick head 40 is compensated for by the greater thickness of the wear-protection disk 20. However, the shorter pick head 40 can then be designed to have a constant outside diameter in the area of its base part 42. The shortened design of the pick head results in lower bending stress in the area between the pick head and the pick shank 10, which area is at risk of fracture. Accordingly, the equivalent tension here is also reduced in favor of an improved head and shaft fracture behavior.

The circumferential groove 21.1 arranged in the area of the support surface 21 provides improved transverse support behavior. During operation, the support surface 21 works its way into an assigned bearing surface of the toolholder. In the area of the circumferential groove 21.1, matching the circumferential groove 21.1, a circumferential bulge is produced at the toolholder like a negative. It is also conceivable to initially provide the toolholder with a bearing surface having a corresponding bulge when it is new. I.e., the centering attachment 21.1 then engages with a corresponding centering receptacle of the toolholder. The circumferential groove 21.1 comes to rest in the area of the bulge. This results in the improved transverse support behavior. Improved transverse support means that the surface pressures are reduced in the upper area of the clamping sleeve, i.e. in the area facing the pick head 40. This prevents excessive wear of the clamping sleeve in this area. The inventors recognized that excessive wear can result in a loss of pretension of the clamping sleeve. As a result of this loss of pretension, the milling pick may accidentally slip out of the toolholder's receiving hole and be lost. The improved support in the radial transverse direction, owing to the centering attachment 21.2 and the circumferential groove 21.1, therefore results in a longer tool life of the milling pick. When using the milling picks in road milling machines, the above-mentioned range of disk thickness d has proved to be advantageous. In this case, the wear-protection disks 20 will reliably fulfill their function for the entire extended service life of the milling pick, and the tool will not have to be replaced prematurely because of a worn clamping sleeve.

As described above, the circumferential groove 21.1 results in better transverse support behavior of the wear-protection disk 20 during operation. This also means that greater forces can be transmitted in radial direction between the wear-protection disk 20 and the toolholder. A greater disk thickness d in the manner described above results in the cut-out in the wear-protection disk 20 providing the pick shank 10 with a larger contact surface. In conjunction with the specified disk thickness d and the circumferential groove 21.1 in the underside of the wear-protection disk 20, greater lateral forces can be transmitted than is possible based on the current state of the art. In conjunction with the shorter design of the pick head, however, this also means that the new design permits higher advance speeds to be achieved or, alternatively, the pick head or pick shank 10 can be designed with optimized tension levels to save material.

The dimensional relationships between the retaining element 15 and the pick shank 10 are set to enable a limited axial offset of the pick shank 10 relative to the retaining element 15. This generates a pumping effect in the axial direction of the milling pick during operation. If milled material enters the area between the bearing surface 41 of the pick head 40 and the counterface 23 during operation, the annular first surface segment 23 forms a kind of sealing area that minimizes the risk of waste material entering the area of the retaining element 15. A kind of mill effect is formed between the bearing surface 41 of the pick head 40 and the surface segments 23.2 and in connection with the flanks 24.1. Penetrating larger particles are crushed and removed via the inclined shape of the recesses 24. This also reduces the risk of material removed from the area of the pick shank 11 penetrating the tool.

As mentioned above, the milling pick has a pick head 40. The pick head 40 also has a lower contact surface 41. This contact surface 41 of the pick head can rest on the counterface 23. The contact surface 41 at least partially covers the annular first surface segment 23.1 and the second surface segments 23.2, as shown in FIGS. 1 and 2. The pick head 40 has a base part 42 adjacent to the bearing surface 41. In this exemplary embodiment the base part 42 is more bulge-shaped. However, other geometries are also conceivable. For example, it is conceivable to provide the base part 42 with a cylindrical geometry, a frustoconical geometry or similar. This base part 42 adjoins a wear surface 43. In this exemplary embodiment, the wear surface 43 has a concave design, at least in some areas, to optimize wear. The wear surface 43 merges into an end area of the pick head 40, which forms a receptacle 45 for a pick tip 30. As shown in the drawings, the end area of the pick head 40 may have a cap-shaped recess in the form of a receptacle 45. A pick tip 30 can be attached in the cap-shaped recess. It is conceivable to use a brazed joint to attach the pick tip 30.

Figure 4:
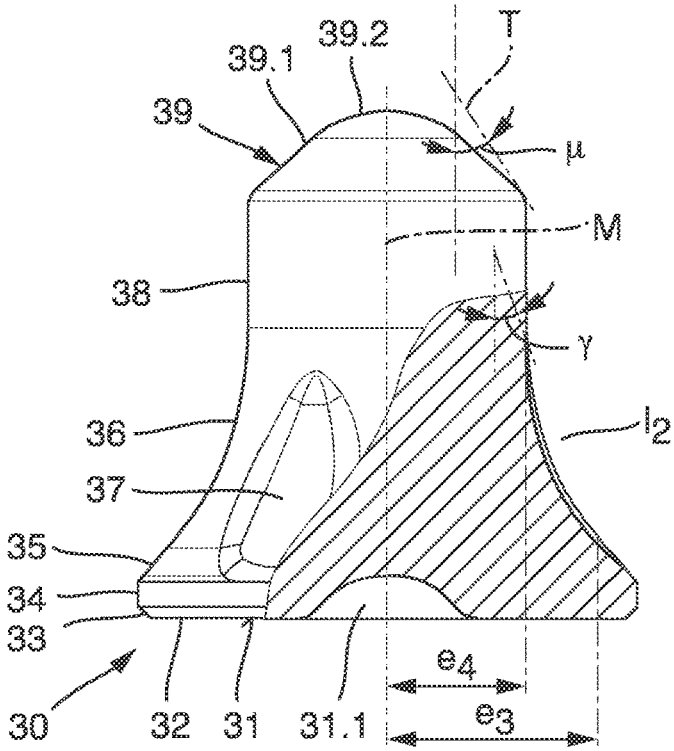
FIG. 4 shows a partially cut side view of the pick tip (30) of FIG. 3

The shape of the pick tip 30 is detailed in drawings 3 and 4. As these illustrations illustrate, the pick tip 30 has a mounting segment 31. In this exemplary embodiment, it is designed as the lower surface 31 of the pick tip 30. As shown in FIG. 4, this lower surface may be provided with a recess 31.1, which may in particular be trough-shaped. The recess 31.1 forms a reservoir, in which excess brazing material can accumulate. In addition, the recess 31.1 reduces the amount of material required to produce the pick tip 30. Usually the pick tip 30 is made of a hard material, especially carbide. That is a relatively expensive material. The recess 31.1 can therefore be used to reduce the effort and expenditure for manufacturing the parts required.

There are attachments 32 on the mounting segment 31 in the area of the underside of the pick tip 30. These attachments 32 can be used to adjust the thickness of the brazing gap between the plane mounting segment 31 and an assigned surface of the pick head 40.

The mounting segment 31 merges into a collar 34 via a chamfer 33. It is also conceivable that there could be a different transition from the mounting segment 31 to the collar 34. In particular, a direct transition of the mounting segment 31 into the collar 34 may also be provided. In this embodiment, the collar 34 is cylindrical. It is also conceivable to make the collar 34, for instance, convexly curved and/or more bulged. The collar 34 can directly or indirectly merge into a concave area 36. The exemplary embodiment shown in the drawings shows the design of an indirect transition. Accordingly, the collar 34 merges via a conical or convexly curved transition segment 35 into the concave area 36.

The concave area 36 can directly or indirectly merge into a connection segment 38. In this case, the design of an immediate transition to the connection segment 38 has been chosen. The connection segment 38 can be cylindrical, as shown in this exemplary embodiment. It is also conceivable to choose a frustoconical shape for the connection segment 38. Slightly convex or concave shapes of the connection segment 38 can also be used. A cylindrical connection segment 38 has the advantage of a design optimized in terms of material and strength. In addition, the connection segment 38 forms a wear area that is reduced during operation, while the pick tip 30 wears out. In this respect, a constant cutting effect is achieved by the cylindrical design of the connection segment 38.

The connection segment 38 is directly or indirectly adjoined by an end segment 39. In this case, an indirect transition is selected, wherein the transition is created by a chamfered contour 39.3. The end segment 39 has a tapered segment 39.1 and an end cap 39.2. Starting with the tapered segment 39.1, the cross-section of the pick tip 30 tapers towards the end cap 39.2. In this respect, especially the end cap 39.2 is the active cutting element of the pick tip 30.

In this exemplary embodiment, the outer contour of the end cap is formed by a spherical dome. The base circle of this spherical dome has a diameter 306. To achieve the sharpest possible cutting effect and, at the same time, a fracture-resistant design of the pick tip 30, it is advantageous if the diameter 306 of the base circle is selected in the range from 1 to 20 mm.

Figure 3:
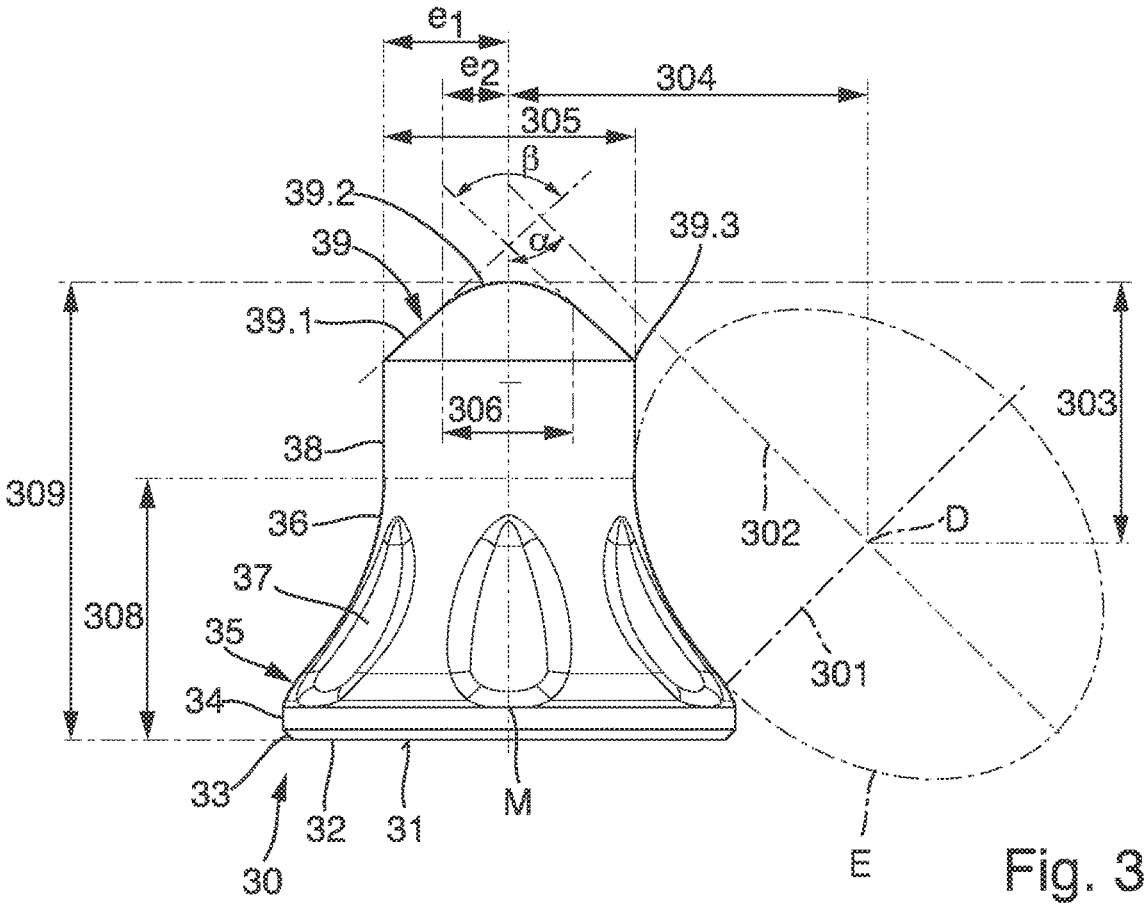
FIG. 3 shows a side view of a pick tip (30) for use on one of the milling picks of FIG. 1 or 2.

The first end area of the tapered segment 39.1 has a maximum first radial extension e1 facing the pick head 40. At its end facing away from the pick head 40, the tapered segment 39.1 has a second maximum radial extension e2. FIG. 3 shows a connection line from a point of the first maximum extension e1 to a point of the second maximum extension e2 as a dashed line. This connection line is at an angle $\beta/2$ of 45° to 52.5° from the central longitudinal axis M of the pick tip 30. An angle of 50° is preferably selected. FIG. 4 also illustrates that a tangent T from the pick tip 30 and through the point of maximum second extension e2 and the central longitudinal axis M form a tangent angle $\mu$, and that this tangent angle $\mu$ is greater than the angle $\beta/2$ formed by the connection line from a point of the first maximum extension e1 to a point of the second maximum extension e2 and by the central longitudinal axis M.

In this case, a spherical geometry of the tapered segment 39.1 has been selected. However, it is also conceivable to select a slightly convex or concave geometry that tapers towards the end cap 39.2.

During the machining operation, the pick tip 30 wears down, shortening in the direction of the central longitudinal axis M. In road milling applications, it has been shown that, given the setting angles of the milling picks selected here, the existing angular range of the connection line proves to be particularly advantageous compared to a milling drum, on which the milling picks are mounted. If a larger angle is selected, too much penetration resistance is caused during the milling process. This results in more required drive power of the milling machine. In addition, the main pressure point for wear action in the transition area between the connection segment 38 and the tapered segment 39.1 then acts on the pick tip 30. This results in an increased risk of edge breakage and premature failure of the pick tip 30. If a smaller angle is selected, the pick tip 30 is initially too efficient in cutting, resulting in high initial longitudinal wear. This reduces the maximum possible service life. For the angle range according to the invention, the effect of pressure during the milling process is distributed evenly over the surfaces of the tapered segment 39.1 and the end cap 39.2. This results in an ideal tool life for the pick tip and at the same time a sufficient cutting efficiency of the milling pick tip 30.

The pick tip 30 has an axial extension 309 in the direction of the central longitudinal axis M in the range from 10 to 30 mm. This area of extension has been optimized for road milling applications. In particular, it may be provided that the ratio of the total length 309 of the pick tip 30 to the maximum diameter of the pick tip 30 is in the range from 0.8 to 1.2. The connection segment 38, which forms the main wear area, can have an axial extension in the range from 2.7 to 7.1 mm.

The concave area 36 of the pick tip 30 has an elliptical contour. The ellipse E creating the elliptical contour is shown as a dashed line in FIG. 3. The ellipse E is arranged such that the large semi-axis 302 of the ellipse E and the central longitudinal axis M of the pick tip 30 form an acute angle $\alpha$. In this exemplary embodiment, the angle $\alpha$ is selected in the range from 30° to 60°, preferably from 40° to 50°, the angle, as shown here, is particularly preferably 45°. The concave area therefore has a geometry that follows the ellipse E. Preferably, the length of the semimajor 302 is selected in the range from 8 mm to 15 mm. In the version shown in FIG. 3, the length of the semimajor 302 is 12 mm. The length of the semiminor is selected in the range from 5 mm to 10 mm. In FIG. 3, a length of 9 mm is selected for the semiminor 301. The semimajor 302 may also be referred to as the semimajor axis 302. The semiminor 301 may also be referred to as the semiminor axis 301. It is noted that lengths of both the semimajor axis 302 and the semiminor axis 301 are measured from the center D to the ellipse E, along the axes identified in FIG. 3.

As FIG. 3 illustrates, the center D of the ellipse E is preferably spaced apart from the transition point between the concave area 36 and the connection segment 38 in the direction of the central longitudinal axis M, wherein the center D is offset from this connecting point in the direction of the pick head 40. This results in a wear-optimized geometry of the concave area 36.

Figure 7:
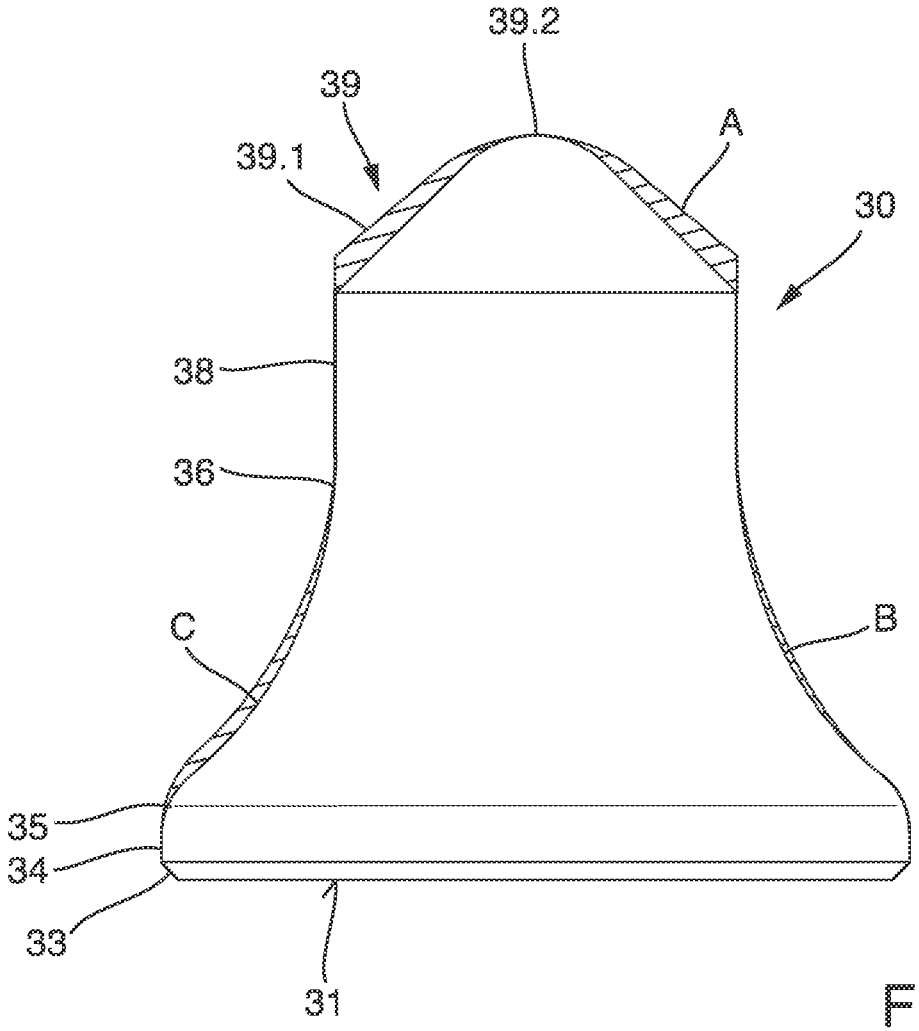
FIG. 7 shows a side view of a pick tip (30) in a comparison position.

FIG. 7 illustrates the effect of the inclination of the ellipse E. FIG. 7 shows a pick tip 30, in which, in accordance with the state of the art as known from DE 10 2007 009 711 A1, a concave contour is selected in the concave area 36 of the pick tip 30, in which the semimajor of the generating ellipse E is arranged in parallel to the central longitudinal axis M of the pick tip 30. As a result of the inclination of the ellipse E, an additional circumferential material area B results. This additional circumferential material area B reinforces the contour of the pick tip 30 in the most heavily stressed area of the pick tip 30. This is the area, in which the highest equivalent tension occurs. Consequently, due to the inclined position of the generating ellipse E, the pick tip 30 is reinforced in the relevant area without requiring a significantly higher amount of material. The pick tip 30 remains slim and retains its cutting efficiency.

On the left side in FIG. 7, in contrast, a contour of the concave area 36 is shown, which has an additional circumferential material area C opposite from the pick tip 30. The contour of this additional circumferential material area C is generated by a radius-shaped geometry, i.e. a circle. It becomes evident that, compared to the material area B, a significant thickening of the pick tip 30 is achieved. As a result, the strength in the critical area of the pick tip 30 is not or only slightly improved compared to the variant having the material area B (inclined ellipse E). At the same time, however, a significantly higher amount of the expensive hard material is required and the pick tip 30 loses its cutting efficiency.

FIG. 7 also illustrates the feature described above, whereby provision is made that in the cross-section of the pick tip 30, a connection line from a point of the first maximum extension e1 to a point of the second maximum extension e2 is at an angle β/2 of 45° to 52.5° from the central longitudinal axis M of the pick tip 30. As the illustration shows, an additional circumferential material area A is created by positioning the connection line at an angle. This additional material area A adds on the one hand additional wear volume in the mostly stressed cutting area and on the other hand has the advantages described above.

The invention claimed is:

1. A milling pick, comprising:

a pick head;

a pick tip made of a hard material harder than the pick head, the pick tip being connected to the pick head, the pick tip having a central longitudinal axis; and wherein the pick tip includes a concave area including an elliptical contour generated by an ellipse arranged such that a semimajor axis of the ellipse and the central longitudinal axis of the pick tip form an acute angle.

2. The milling pick of claim 1, wherein:

the acute angle is in a range of from 30° to 60°.

3. The milling pick of claim 1, wherein:

the acute angle is in a range of from 40° to 50°.

4. The milling pick of claim 1, wherein:

a ratio of a length of the semimajor axis to a length of a semiminor axis of the ellipse generating the elliptical contour is in a range from 1.25 to 2.5.

5. The milling pick of claim 1, wherein:

the concave area does not intersect the semimajor axis and a semiminor axis of the ellipse generating the elliptical contour.

6. The milling pick of claim 1, wherein:

the pick tip includes a connection segment adjoining the concave area at a transition point and facing away from the pick head; and a center of the ellipse generating the elliptical contour is spaced apart from the transition point in a direction of longitudinal extension of the central longitudinal axis toward the pick head.

7. The milling pick of claim 1, wherein:

the pick tip includes a connection segment adjoining the concave area and facing away from the pick head, the connection segment being either cylindrical or frustoconical having a cone angle of less than 20°.

8. The milling pick of claim 1, wherein:

the pick tip includes a plurality of recesses in the concave area, the recesses being spaced around a circumference of the pick tip.

9. The milling pick of claim 8 wherein:

the recesses are spaced equidistantly from each other.

10. The milling pick of claim 8 wherein:

the recesses have a depth from an outer surface of the concave area in a range from 0.3 mm to 1.2 mm.

11. The milling pick of claim 1, wherein:

the pick tip includes a connection segment adjoining the concave area and facing away from the pick head; and the pick tip includes an end segment directly or indirectly connected to the connection segment and facing away from the pick head, the end segment including a tapered segment and an end cap;

wherein the tapered segment includes a maximum radial first extension at a first end facing the pick head and a maximum radial second extension at a second end facing away from the pick head;

wherein the end cap forms a free end of the pick tip and is configured as a spherical dome having a base circle having a diameter; and wherein a ratio of twice the maximum radial first extension to the diameter of the base circle is in a range from 1.25 to 2.25.

12. The milling pick of claim 11, wherein:

a connection line from a point of the maximum radial first extension to a point of the maximum radial second extension is at an angle from the central longitudinal axis in a range of from 45° to 52.5°.

13. The milling pick of claim 11, wherein:

a connection line from a point of the maximum radial first extension to a point of the maximum radial second extension is at an angle from the central longitudinal axis in a range of from 47.5° to 52.5°; and wherein the tapered segment is frustoconical or convex in shape.

14. The milling pick of claim 11, wherein:

a connection line from a point of the maximum radial first extension to a point of the maximum radial second extension is at an angle from the central longitudinal axis in a range of from 45° to 50°; and wherein the tapered segment is convex in shape.

15. The milling pick of claim 1, wherein the pick tip is made from carbide.

16. The milling pick of claim 15, wherein the pick tip is brazed to the pick head.

17. The milling pick of claim 15, wherein:

the pick head includes a cup-shaped receptacle; and the pick tip is attached to the cup-shaped receptacle by a brazed joint.

18. The milling pick of claim 1, wherein:

the concave area has a maximum radial extension at an end of the concave area closest to the pick head and a minimum radial extension at an end of the concave area furthest from the pick head, and a connection line from the maximum radial extension to the minimum radial extension forms an acute angle in a range of from 20° to 25° with the central longitudinal axis.

* * * * *